US009452432B2

(12) United States Patent
Baroud et al.

(10) Patent No.: US 9,452,432 B2
(45) Date of Patent: Sep. 27, 2016

(54) MICROFLUIDIC CIRCUIT

(75) Inventors: Charles Baroud, Paris (FR); Rémi Dangla, Paris (FR); Francois Gallaire, Savigny-Suisse (FR)

(73) Assignees: ECOLE POLYTECHNIQUE, Palaiseau (FR); LE CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 389 days.

(21) Appl. No.: 13/498,927

(22) PCT Filed: Sep. 29, 2010

(86) PCT No.: PCT/FR2010/052051

§ 371 (c)(1),
(2), (4) Date: Aug. 21, 2012

(87) PCT Pub. No.: WO2011/039475

PCT Pub. Date: Apr. 7, 2011

(65) Prior Publication Data

US 2012/0315203 A1 Dec. 13, 2012

(30) Foreign Application Priority Data

Sep. 29, 2009 (FR) ..... 09 04639

(51) Int. Cl.
*B01L 3/00* (2006.01)

(52) U.S. Cl.
CPC .. *B01L 3/502784* (2013.01); *B01L 2200/0652* (2013.01); *B01L 2300/089* (2013.01); *B01L 2300/0864* (2013.01); *B01L 2400/0406* (2013.01); *B01L 2400/086* (2013.01)

(58) Field of Classification Search
CPC ..... B01L 3/502784; B01L 2300/089; B01L 2300/0864; B01L 2400/086; B01L 2200/0652; B01L 2400/0406
See application file for complete search history.

(56) References Cited

U.S. PATENT DOCUMENTS

2006/0003439 A1* 1/2006 Ismagilov ..... B01F 5/0471 435/287.2
2007/0111302 A1* 5/2007 Handique ..... B01F 5/061 435/287.2

(Continued)

FOREIGN PATENT DOCUMENTS

EP 0 014 797 9/1980 ..... G01N 1/28
EP 1 627 685 2/2006 ..... B01L 3/00

(Continued)

OTHER PUBLICATIONS

International Search Report for International Application No. PCT/FR2010/052051, Dec. 28, 2010.

*Primary Examiner* — Lore Jarrett
(74) *Attorney, Agent, or Firm* — Kusner & Jaffe

(57) ABSTRACT

The invention relates to a microfluidic circuit including at least one microchannel for the flow of a first fluid conveying drops or bubbles of at least one second fluid, characterized in that the height of the microchannel is sized so as to crush the drops or bubbles during the movement thereof, and in that the microchannel comprises at least one trough, extending at least partially in the direction of flow of the first fluid or an area for trapping drops or bubbles, said area or the trough having a height that is greater than the height of the microchannel, such that at least some of the drops or bubbles of the second fluid in the microchannel are drawn and guided into the trough or into the trapping area.

20 Claims, 5 Drawing Sheets

(56) References Cited

U.S. PATENT DOCUMENTS

| | | | | |
|---|---|---|---|---|
| 2008/0093306 | A1 | 4/2008 | Oakey et al. | 210/748 |
| 2008/0185057 | A1* | 8/2008 | Prakash et al. | 137/594 |
| 2009/0090422 | A1* | 4/2009 | Baroud | B01L 3/502784 137/827 |
| 2009/0326827 | A1* | 12/2009 | Mostowfi | B01L 3/502784 702/12 |

FOREIGN PATENT DOCUMENTS

| | | | |
|---|---|---|---|
| WO | WO 02/085520 | 10/2002 | B01L 3/00 |
| WO | WO 2006/018490 | 2/2006 | B01L 3/00 |
| WO | WO 2007/138178 | 12/2007 | B01L 3/00 |
| WO | WO 2008/124846 | 10/2008 | C12M 3/00 |

* cited by examiner

MICROFLUIDIC CIRCUIT

FIELD OF THE INVENTION

This invention relates to a microfluidic circuit comprising at least one microchannel wherein is flowing a first fluid serving for the movement of drops or of bubbles of at least one second fluid.

BACKGROUND OF THE INVENTION

A microfluidic circuit is described in document WO 2006/018490 in the name of the applicants. The latter is made from a suitable material such as for example PDMS (polydimethylsiloxane) comprising microchannels having typically a width of approximately 100 μm and a depth of approximately 50 μm, wherein can be passed very low flows of a fluid such as air, water, oil, reagents, etc.

A laser beam of which the wavelength is not absorbed by the material comprising the circuit, is focussed on the interface of a first fluid flowing in a microchannel and of a second fluid present at least locally in this microchannel, in order to force or stop the flow of the first fluid in the microchannel, in order to break it up into drops, in order to mix it with the second fluid, etc., the focussing of the laser beam on the interface of the fluids creating a temperature gradient along this interface and provoking a movement of fluids via thermocapillary convection.

As this is known in WO 2007/138178, also in the name of the applicants, this technology was used in order to treat drops in a microfluidic circuit comprising at least one microchannel travelled by the drops. The method used consists in having a laser beam act on the interface of these drops in a carrier fluid or on the interface of the drops in contact, in order to sort drops, form nanodrops from a drop of greater size or to merge drops in contact and provoke reactions between the fluids contained in these drops.

SUMMARY OF THE INVENTION

The invention has for object another method of treating drops in a microfluidic circuit, which can possibly be used in combination with the prior treatment techniques described hereinabove.

To this effect, the invention proposes a microfluidic circuit comprising at least one microchannel for the flow of a first fluid conveying drops or bubbles of at least one second fluid, characterised in that the height of the microchannel is sized to crush the drops or the bubbles during their movement, and in that the microchannel comprises at least one trough, extending at least partially in the direction of flow of the first fluid or an area for trapping drops or bubbles, this area or the trough having a height that is greater than that of the microchannel, in such a way that at least certain drops or bubbles of the second fluid in the microchannel are drawn and guided into the trough or into the area for trapping.

In the case of a drop plunged into a fluid, the surface energy of the drop is all the lower than its external surface is small. The minimum energy is therefore obtained by a drop of spherical shape and increases continuously as the drop moves away from this shape. The surface energy can be calculated for a drop of known volume, for any position in the microchannel. As such, it can be predicted whether or not the drop will be guided by a given trough by comparing the forces at play.

A drop placed in the microchannel and crushed has a substantial external surface. This drop as such naturally attempts to reduce its external surface, which leads it to migrate towards the trough of a greater height when it arrives at a branching between the microchannel and the trough.

The drops are as such drawn by the trough and are displaced along the latter by the first fluid.

In the case where the direction of the trough is not parallel to the direction of the flow of the first fluid (carrier fluid) in the microchannel, the drop remains prisoner of the trough as long as the viscous drag force, in the direction normal to the local direction of the trough and exerted by the first fluid on the drop, is less than that required to deform the drop and give it back its crushed form.

This phenomenon is as such influenced by several parameters, such as the viscosity of the carrier fluid and that of the fluid of the drops, the size of the drop, the speed of the carrier fluid, the interfacial tension, the geometry of the trough, the thickness of the microchannel, etc.

Of course, it is possible to use indifferently drops or bubbles, without modification on the operation of the invention.

According to a characteristic of the invention, the microchannel is delimited by two parallel walls, and the trough is formed by a groove of at least one of the walls of the microchannel, or between two parallel ribs of one of the walls of the microchannel.

Advantageously, bubbles or drops of at least two different types are conveyed by the first fluid and the trough constitutes a means for separating or sorting bubbles or drops, with only those of a first type being guided into the trough.

As described above, the drops which are drawn by the trough are those for which the viscous force exerted by the first fluid on each drop is less than that required to deform the drop and give it back its crushed form.

Inversely, the drops which flow in the direction of the carrier fluid without following the trough are those for which the viscous force exerted by the first fluid on the drop is higher than that required to deform the drop and give it back it crushed form.

Consequently, drops of large size or very viscous drops will be less inclined to follow the trajectory of the trough than drops of small size or those that are hardly viscous.

According to a possibility of the invention, bubbles or drops of different types have different sizes, viscosities, or surface tensions, which makes it possible to separate them from one another.

In an embodiment, the trough comprises at least two successive portions of different height and/or width, with a portion of larger width and/or height being followed by a portion of lower width and/or height, in the direction of the flow of the first fluid.

This type of trough makes it possible to easily separate two types of bubbles or drops. By way of example, bubbles with high viscosity or of large size will flow only along the portion with great height of the trough before being driven out of the trough by the carrier fluid, while bubbles with lower viscosity or of smaller size will flow not only along the portion with great height of the trough but also along its portion with lower height.

According to another characteristic of the invention, the circuit comprises troughs with a different width and/or different inclination in relation to the flow of the first fluid, which also makes it possible to be able to discriminate different types of bubbles or drops.

Advantageously, the circuit comprises areas for trapping drops or bubbles, formed by an enlargement of the section of passage of the drops or of the bubbles in the microchannel or in an aforementioned trough, or via a local modification of the surface energy of the microchannel and/or of the trough.

The circuit can include areas for trapping in the microchannel, even in the absence of the trough. The drops or the bubbles conveyed by the carrier fluid are then trapped in the areas for trapping placed on their trajectory.

Moreover, these areas for trapping can be smaller than the size of the drops or bubbles to be trapped.

These areas for trapping can be adapted to a single type of bubbles and/or can contain only a defined number of bubbles, for example one or two bubbles.

The areas for trapping make it possible to immobilise one or several drops, which makes it possible for example to examine them using a microscope and/or to follow the unfolding of a reaction within an area for a substantial period of time.

At least certain areas for trapping can be independent from one another.

Alternatively, at least certain areas for trapping are connected in, series or in parallel by the microchannel or by the aforementioned troughs.

The trap can be manufactured in such a way that the presence of a drop in the latter forces the following drops to continue their carrying, in order to fill the traps located downstream.

A trapped drop is stationary but its contents continue to be placed in movement by the flow of the carrier fluid. In this way, the contents of the drop can be mixed even when the latter is stationary. Such a phenomenon can in particular play an important role in the field of biological incubation or for the setting up of a chemical reaction.

It is as such possible to bring drops in the vicinity of one another or in contact with one another, in order to merge them and initiate a chemical reaction, or to compare their contents.

In the case of an area for trapping connected in series to one another, the jumping of one or several drops from one area for trapping to another can result, via the cascade effect, the movement of the trapped drops in the areas located downstream.

According to another characteristic of the invention, obstacles are formed downstream of certain areas for trapping in order to retain in these areas the bubbles or the drops that have been drawn therein.

Advantageously, at least one trough comprises means for slowing down or accelerating bubbles or drops present in the trough, these means for slowing down or accelerating being formed by variations in width or in height of the trough, or by rails or ribs of the walls of the corresponding microchannel, formed along the desired areas for slowing down or accelerating.

According to another characteristic of the invention, the circuit comprises means for forming parallel streams of drops or bubbles of a different nature in a microchannel comprising parallel means of introducing drops or bubbles of a different nature in the microchannel, and troughs formed in this microchannel using means for introducing in order to guide the drops or the bubbles exiting from each means for introducing until a predetermined area of the microchannel.

Each type of drop is as such brought to a predefined location of the microchannel. It is then possible to arrange series of drops of a known nature at different levels of the microchannel.

BRIEF DESCRIPTION OF THE DRAWINGS

The invention shall be better understood and other details, characteristics and other advantages of the invention shall appear when reading the following description given by way of a non-restricted example in reference to the annexed drawings wherein.

DETAILED DESCRIPTION OF THE INVENTION

Figure 1:
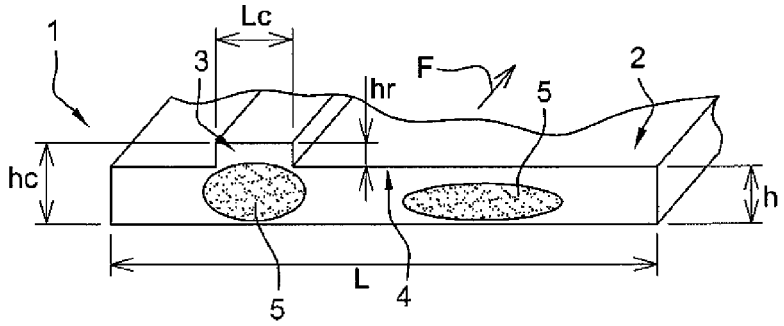
FIG. 1 is a diagrammatical view showing the section of the microchannel.

FIG. 1 diagrammatically shows a first embodiment of a microcircuit 1 according to the invention.

The microcircuit 1 is formed in a plate from a suitable material such as for example PDMS (polydimethylsiloxane) through the use of a common technique of flexible lithography, as is known in the aforementioned prior art.

One or several microchannels 2 can be formed at the surface of the plate, whereon is glued a glass microscope slide, for example.

As can be seen in FIG. 1, the microchannel 2 has a rectangular section, of which the width L is defined by its horizontal transversal dimension, i.e. in the plane of the microcircuit 1, and of which the height h is defined by its dimension in the vertical direction, i.e. according to a direction perpendicular to the plane of the microcircuit 1.

Of course, the preceding terms are used only through reference to the drawings, and remain valid regardless of the orientation of the microcircuit.

A groove 3 with rectangular or square section is arranged in one of the two horizontal walls 4 that delimit the microchannel 2. According to an alternative embodiment of the invention, a second groove can be arranged in the opposite horizontal wall, across from the first 4.

The groove 3 as such forms a trough of greater section than the rest of the microchannel 2.

A first fluid, called carrier fluid, circulates in the microchannel 2, in the direction indicated by the arrow F, by drawing with it drops 5 of a second fluid, of a different nature than the first fluid.

In what follows, the second fluid can be in the form of drops or bubbles, without modification of the operation of the invention.

The drops 5 flowing into the narrow area of the microchannel are crushed. When they encounter a trough 3, they take therein a less crushed form, for example a spherical or quasi-spherical shape, requiring less surface energy than the crushed form. Note that the drops can remain crushed while still being guided by the trough. The determining criterion is that the surface energy of the drop in the trough be smaller than that outside of the trough, the sphere corresponding to the minimum of this energy.

The drops 5 that encounter the trough 3 then circulate along the latter, being carried away therefrom by the carrier fluid.

The drops can be larger or smaller than the trough 3.

Figure 2:
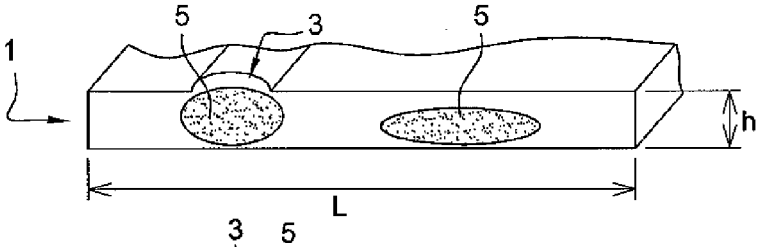
FIGS. 2 and 3 are views corresponding to FIG. 1, showing two other embodiments of the invention.

FIG. 2 shows an alternative embodiment of the invention wherein the groove defining the trough 3 has a concave or rounded shape.

Figure 3:
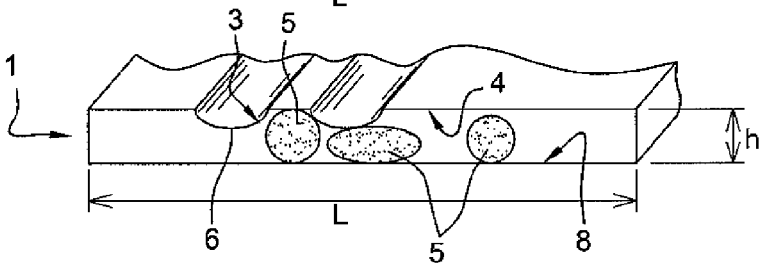

Another alternative embodiment is represented in FIG. 3, wherein one of the horizontal walls 4 is provided with two parallel ribs 6, spaced from one another, directed towards the interior of the microchannel 2 and delimiting between them a trough 3.

In this way, the drops 5 crushed between the top of the ribs 6 and the opposite wall 8, are directed either towards the trough 3, or in the other areas of the microchannel 2 located on either side of the ribs 6. In these areas, the drops 5 can return to a spherical or quasi-spherical shape and therefore a lower surface energy. In this way, the ribs form barriers making it possible to separate certain drops from others.

Figure 4:
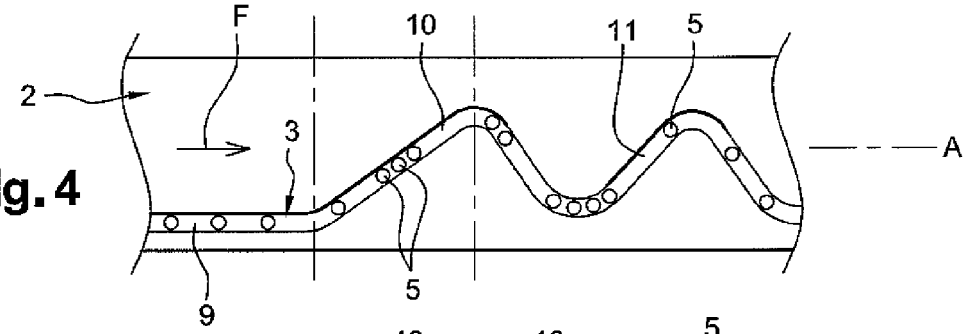
FIG. 4 shows, in a top view, a microchannel provided with a trough.

FIG. 4 shows, in a top view, the form of a trough 3. In this example, the trough 3 comprises at least one portion 9 extending according to the axis A of the microchannel and therefore according to the axis of flow F of the carrier fluid, at least one portion 10 extending obliquely in relation to the aforementioned axis A, and/or at least one portion 11 of sinusoidal shape.

In each of the aforementioned portions, the trajectory of the drops 5 circulating along the trough 3 has a component according to the direction of flow of the carrier fluid, in such a way that the drops 5 are always drawn by the carrier fluid, from upstream to downstream of the trough 3 and of the microchannel 2.

In the case of an oblique portion 10 or of a sinusoidal portion 11 in particular, the travel time of the drops 5 in the microchannel 2 is greater. In this way, the contents of the drops 5 can be observed using a microscope for a longer period, without having tom modify the observation area over time.

Figure 5:
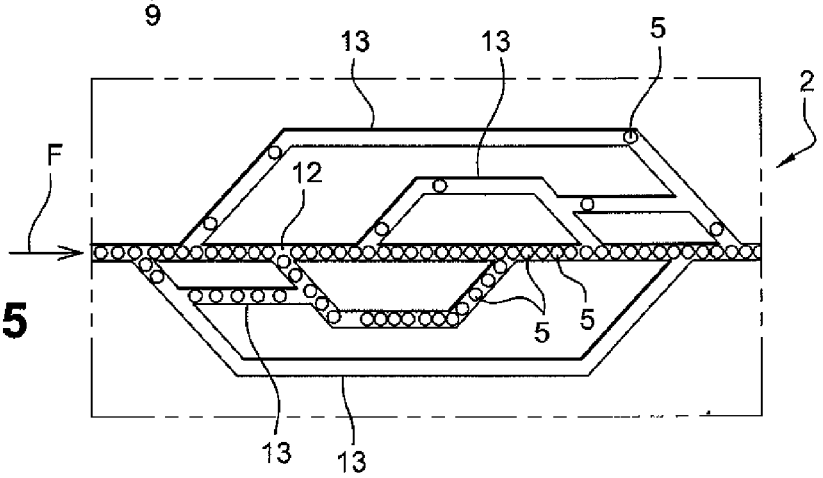
FIG. 5 shows, in a top view, a microchannel provided with a network of troughs.

FIG. 5 shows a network of troughs comprising a central trough 12 extending in the direction of the microchannel 2, on either side of which extend several auxiliary troughs 13. Each auxiliary trough 13 extends from the central trough 12 and exits again in the latter, in the manner of diversion troughs.

In the case on FIG. 5, the drops 5 contain for example water and the carrier fluid is paraffin, the width of the microchannel 2 is 3 mm, that of the troughs 12, 13 is 70 μm, the heights of the microchannel and of the troughs are respectively 50 μm and 35 μm, and the drops 5 flow from left to right in the direction of the arrow F.

Figure 6:
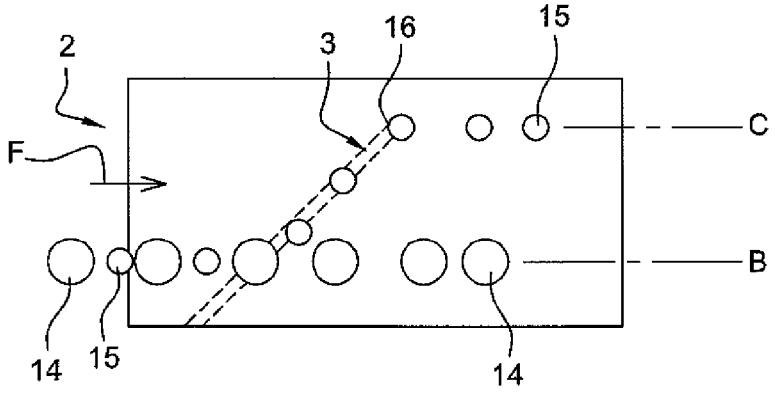
FIGS. 6 to 9 are top views of a microchannel according to different embodiments of the invention aiming to separate drops of different natures.

FIG. 6 shows a microchannel 2 wherein circulates a first fluid forming a carrier fluid for drops of a first and of a second types. The drops of the first type 14 have a larger size than the drops of the second type 15.

The microchannel 2 is provided with a trough 3 extending obliquely from upstream to downstream in relation to the direction of circulation of the carrier fluid, shown by the arrow F. The height and/or the width of the trough 3 are adjusted in such a way that the largest drops 14 are carried away with the carrier fluid in the direction of the arrow F and that the smallest drops 15 are drawn into the trough 3, then progress along the latter, from upstream to downstream, being drawn therefrom by the carrier fluid.

The downstream end 16 of the trough 3 is provided with a reduction in its height or in its width in such a way that the viscous force exerted by the carrier fluid is greater than that required to crush the drops 15, so that the carrier fluid draws them again into the microchannel 2. The drops 14 and 15 circulate as such, downstream of the trough 3, respectively according to two axes B and C parallel to the flow of the carrier fluid and separated from one another.

Such a microchannel as such makes it possible to sort two types of drops of a different nature.

Figure 7:
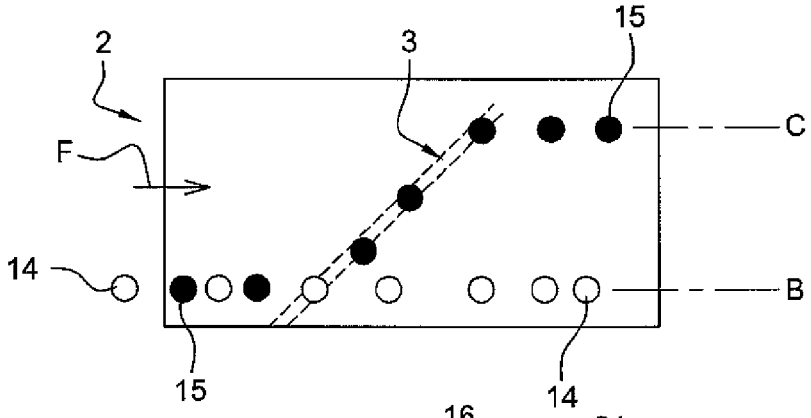

FIG. 7 shows a microchannel 2 similar to that in FIG. 6, wherein the drops of the first type 14 are relatively very viscous and the drops of the second type 15 are relatively hardly viscous.

The height and/or the width of the trough 3 are adjusted in such a way that the most viscous drops 14 are carried away with the carrier fluid and that only the viscous drops 15 are drawn into the trough, then progress along the latter, from upstream to downstream, by being drawn by the carrier fluid and exit from the trough 3 at the downstream end of the latter.

Recall that the more viscous the drop is, the stronger the effort exerted by the carrier fluid on the drop is, this effort allowing for the extraction of the drop outside of the trough.

Such a microchannel 2 can also be used to sort drops having different surface tensions.

Figure 8:
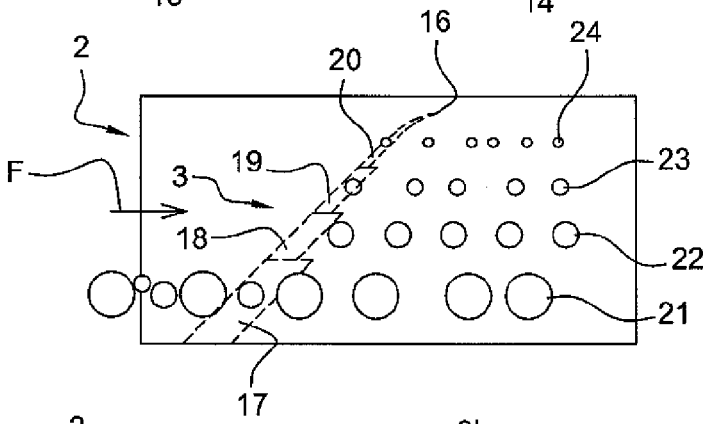

FIG. 8 shows a microchannel of the type of those of FIGS. 6 and 7, wherein the trough successively has, from upstream to downstream, areas of decreasing height and/or width 17 to 20.

Each area is sized in such a way as to be able to discriminate a particular type of drop.

In the case shown in FIG. 8, the carrier fluid draws four types of drops of different sizes or viscosities across from the first area 17, i.e. the widest and/or the deepest area.

The drops of the first type 21, i.e. the largest or the most viscous are drawn through this area 17 by the carrier fluid, the trajectory of these drops 21 hardly being influenced by the presence of the trough 3.

The drops of the second, of the third and of the fourth types 22, 23, 24, smaller or less viscous than the first ones 21, are drawn by the first area 17 of the trough 3 and follow the latter from upstream to downstream being carried away therefore by the carrier fluid, until arriving at the second area 18, with a lower width and/or height.

The second area 18 is sized in such a way that the drops of the second type 22 cannot penetrate therein. These drops 22 are therefore extracted from the trough 3 and then circulate in the microchannel 2, according to an axis parallel to the flow of the carrier fluid and separated from their original axis of circulation.

In the same manner as previously, the other areas 19 and 20 of the trough 3 are sized in such a way that the drops of the third type 23 circulate successively in the first, second and third areas 17, 18, 19 before escaping outside of the trough 3, and that the drops of the fourth type 24 circulate in each of the areas 17 to 20 of the trough 3 before escaping at the downstream end 16 of the trough 3.

In this way, the drops of each type 21 to 24 circulate, downstream of the trough 3, respectively according to axes of circulation that are parallel and separated from one another.

Such a microchannel therefore makes it possible to sort four types of drops of a different nature.

Of course, the number of different areas of the trough can be adjusted according to need.

Figure 9:
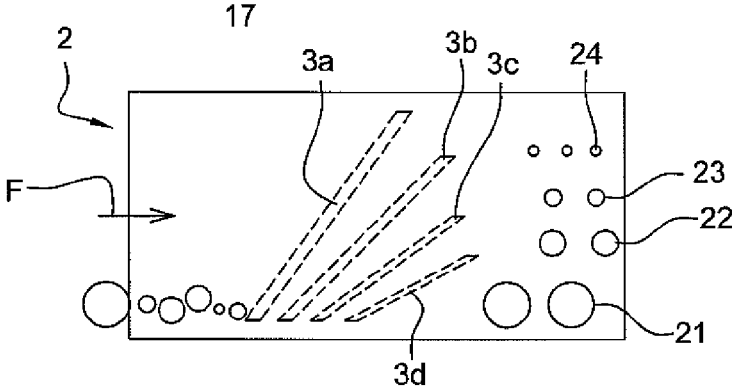

It is also possible to separate several types of drops by arranging different troughs 3 of different dimensions and/or inclinations in the microchannel in relation to the direction of flow F of the carrier fluid, as is shown in FIG. 9.

In this figure, the microchannel 2 is formed with four successive troughs 3, of which the inclinations in relation to the flow of the first fluid are increasingly lower. The first trough 3*a*, the most inclined, separates the smallest drops 24, the second channel 3*b* separates the drops that are a little larger 23, the third channel 3*c* separates the drops that are even larger 22, and the fourth channel 3*d* separates the largest drops 21.

Figure 10:
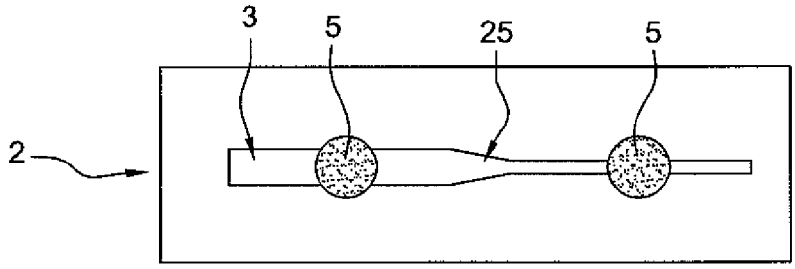
FIG. 10 is a top view of a microchannel provided with a trough comprising means for slowing down drops.

The microchannel 2 can also be provided with a trough 3, extending for example according to the axis of circulation of the carrier fluid, and provided with a reduction in its width 25 and/or in its height. This reduction can have the form of a step or of a discontinuous step, or a progressive shape such as that which can be seen in FIG. 10.

In this way, a drop 5 flowing in the trough being carried away therefrom by the carrier fluid will be slowed when passing through the contraction 25.

In the case where the speed of the carrier fluid is zero, the geometry of the troughs can be used as an engine to convey the drops. In this way, the invention makes it possible to displace the drops in a two-dimensional field, even in the absence of a flow of a carrier fluid. The invention can even be used so as to displace drops against the current in relation to the flow of the carrier fluid.

Figure 11:
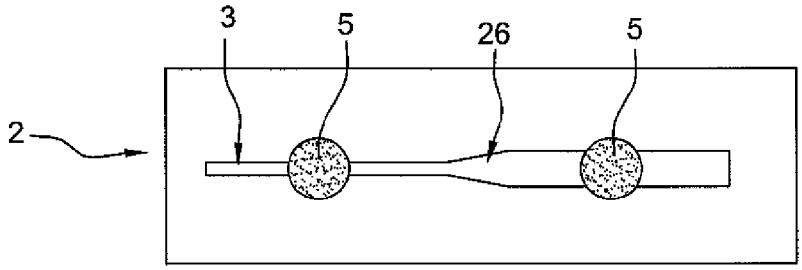
FIG. 11 is a top view of a microchannel provided with a trough comprising means for accelerating drops.

Inversely, as shown in FIG. 11, the trough 3 can be provided with an enlarging area 26 in steps or progressive, in such a way that the drop 5 circulating in the trough 3 is accelerated when passing through this area.

Figure 12:
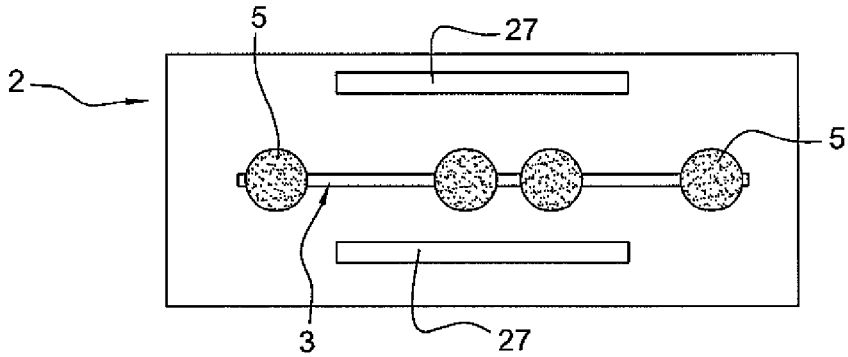
FIG. 12 is a top view of a microchannel provided with a main trough and annex troughs aiming to slow down the drops of the main trough.

The slowing of the drops 5 can also be obtained (FIG. 12) by arranging on either side of the trough 3 wherein they circulate, secondary troughs 27 having for function to locally increase the section of the microchannel 2. This has for effect to locally decrease the speed of circulation of the carrier fluid, and, consequently, the speed de circulation of the drops 5.

Of course, the number, the shape and the position of the secondary troughs 27 can be modified according to need, with the important point being the local increase in the section of the microchannel. The reverse effect can be obtained by replacing the troughs 27 with ribs forming a local reduction of the section of the microchannel 2.

Figure 13:
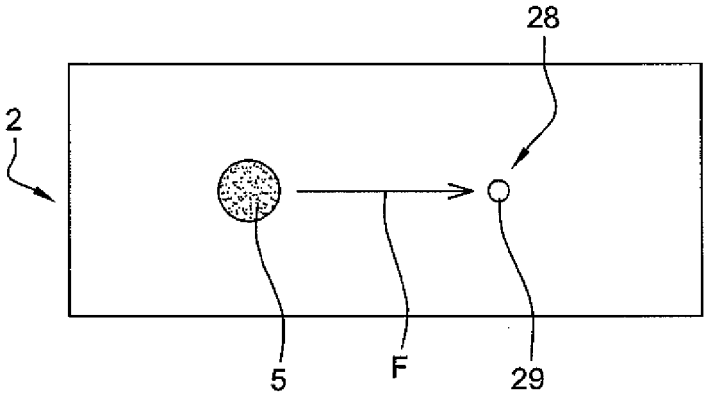
FIG. 13 is a top view of a microchannel provided with an area for trapping bubbles, in the absence of a trough.

FIG. 13 shows a microchannel 2 comprising an area for trapping 28 drops, formed by a pocket or a cavity 29 made in the wall of the microchannel 2. In this embodiment, the microchannel is not provided with a trough, the drops conveyed by the flow of the carrier fluid F being trapped in the area or areas for trapping if the latter are located on the trajectory of the drops. The area for trapping can be smaller or larger than the drops or the bubbles to be trapped, according to applications and of the nature of the drops or of the bubbles.

Figure 14:
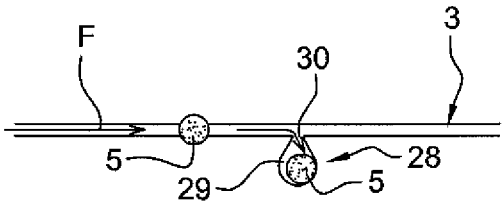
FIGS. 14 and 15 are top views of a trough provided with areas for trapping bubbles.

FIG. 14 shows a trough 3 provided with an area for trapping 28 drops, formed by a pocket or cavity formed on a side of the trough 3, in a wall 4 of the microchannel 2.

The pocket 29 is connected to the trough 3 by a mouth 30 and is able to trap a predefined number of drops. In the case of FIG. 13, this area only makes it possible to contain a single drop 5.

The section of the mouth 30 can be adapted according to the applications. In the case where the mouth 30 has a larger section than that of the trough 3, the drop or drops 5 can be automatically drawn into the areas for trapping 28.

In the case where the mouth 30 has a smaller section or substantially equal to that of the trough 3, it may be required to force the drops 5 to enter into the area for trapping 28. This can be carried out by any suitable means, in particular using the method described in WO 2006/018490 and WO 2007/138178 and which uses a laser beam directed on the interface between a drop and the carrier fluid or between two drops, in order to influence the movement of the drops.

The drops 5 can be withdrawn from the areas for trapping 28 by increasing the flow of the carrier fluid, or by forcing the drops 5 to exit using the aforementioned method.

Figure 15:
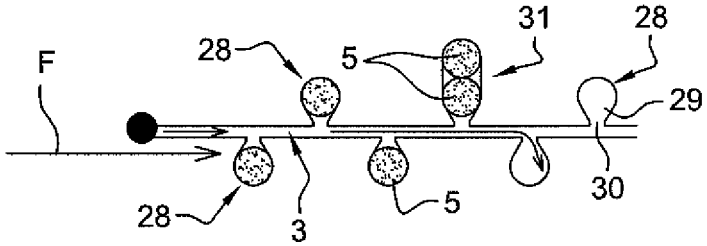

FIG. 15 shows a trough 3 on either side of which are formed several areas for trapping 28, 29, separated from one another and arranged in a staggered manner. Each area for trapping 28, 29 can be sized to trap a predefined number of drops 5, one drop for the case of areas 28 and two drops for the case of the area 31, and/or to trap drops of a particular nature.

Figure 16:
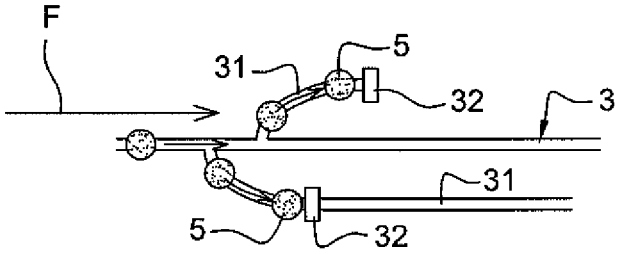
FIG. 16 is a top view of a network of troughs comprising obstacles.

The microchannel 2 can also be provided with a network of troughs formed of a main trough 3, through which the drops arrive, from which extend one or several diverted troughs 31 wherein are arranged obstacles 32 making it possible to retain, at least temporarily, the drops 5 in the corresponding diverted trough 31, as can be seen in FIG. 16. The latter then form areas for trapping. The diverted troughs 31 may or may not extend downstream of the obstacle 32.

Figure 17:
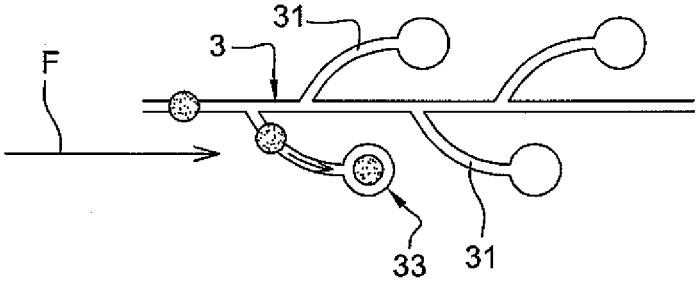
FIG. 17 is a top view of a network of troughs comprising wetting areas.

According to another alternative embodiment of the invention, which can be seen in FIG. 17, the annex troughs 31 can be provided with wetting areas 33. A wetting area is formed by an area of which the wetting properties of the wall 4 have been modified.

This can be carried out for example using a drop of water which is stopped or slowed in an area rendered hydrophilic. The modification of the wetting properties can also be obtaining using chemical methods, such as silanisation or plasma etching, or by using physical methods, for example by introducing hydrophilic lugs onto which the drop will catch (fakir effect).

The area for trapping can also comprise elements intended to react with the contents of the drops, in such a way as to form microreactors or so as to detect the presence of chemical and/or biochemical molecules in the drop or drops concerned. By way of example, a DNA sequence can be detected if the complementary sequence is placed locally on the wall of the corresponding area for trapping.

Figure 18:
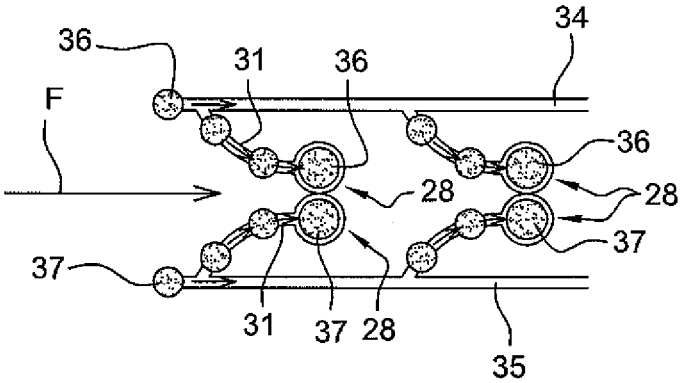
FIG. 18 is a top view of troughs forming microreactors.

Several drops can also be brought into the vicinity or in contact with one another as is shown in FIG. 18. For this, the microchannel comprises for example two parallel troughs 34, 35, each intended for the circulation of a particular type of drops 36, 37, from which extend diverted troughs 31 of which the downstream ends form areas for trapping 28.

The areas for trapping 28 are arranged in the vicinity or adjacently in relation to one another in such a way that a drop of a first type 36 is in the vicinity or in contact with a drop of a second type 37.

It is then possible to merge the two drops 36, 37 and to have their contents react, or to compare their content.

Figure 19:
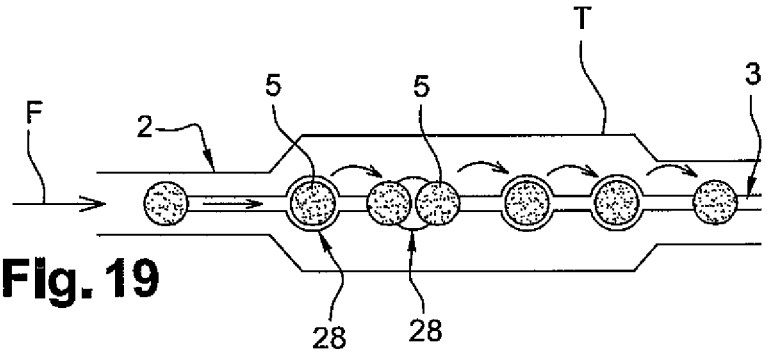
FIG. 19 is a top view of a microchannel comprising a trough provided with areas for trapping arranged in series.

FIG. 19 shows a microchannel 2 having a trough 3 provided with several successive areas for trapping 28, arranged in series.

When a drop 5 is trapped in each of the areas for trapping 28 and an additional drop arrives via the trough 3, the latter dislodges the drop from the upstream trap which, itself, dislodges the drop from the trap located directly downstream of the previous one. This results, via the cascade effect, in the movement of all of the drops 5, from one area for trapping 28 to another.

The areas for trapping 28 form a buffer area T defined by an enlargement of the microchannel and wherein the drops 5 spend a determined duration required for example to incubate a chemical or biochemical reaction and/or to allow for their observation.

Figure 20:
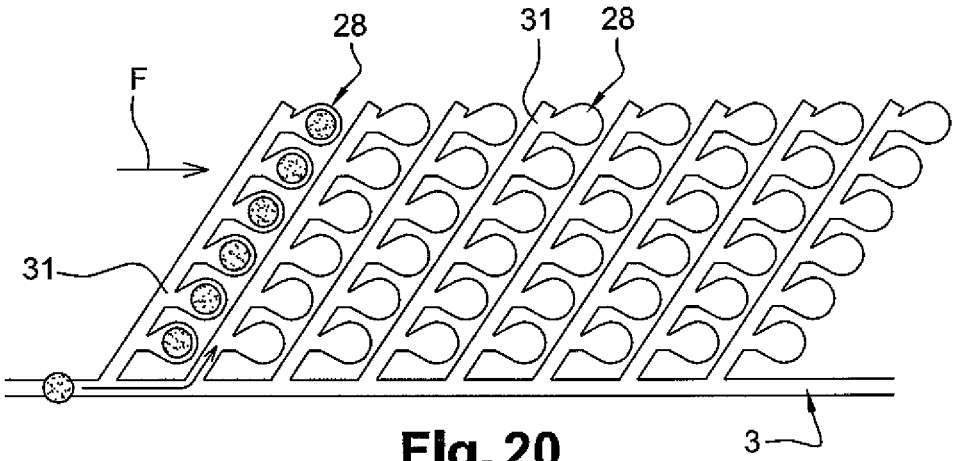
FIG. 20 is a top view of a matrix array of areas for trapping.

The area for trapping 28 can also be with a matrix layout as shown in FIG. 20, by the intermediary of a main trough 3 and of parallel diverted troughs 31, each connected to a determined number of areas for trapping 28.

Figure 21:
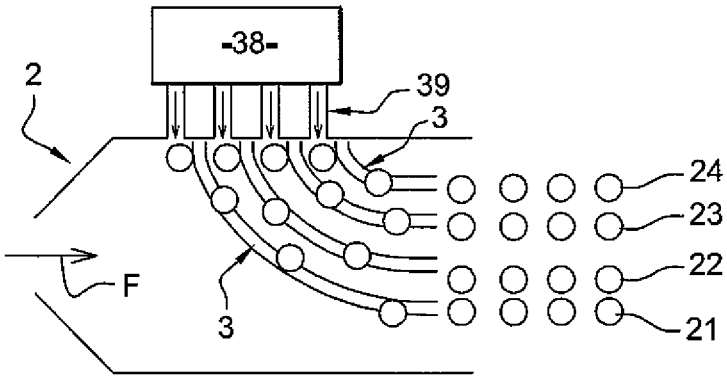
FIG. 21 shows a microchannel comprising means for supplying parallel streams of drops of a different nature.

FIG. 21 shows a microchannel 2 comprising means of supplying 38 parallel streams of drops of a different nature 21 to 24, parallel means of introducing 39 drops of a different nature into the microchannel 2, and troughs 3 formed in the microchannel 2 using means for introducing 39 to guide the drops 21 to 24 exiting from each means for introducing until a predetermined area of the microchannel 2. Parallel streams of different drops are thus formed in the microchannel.

The microchannels presented hereinabove for the treatment of drops in a carrier fluid can also be used for the treatment of bubbles.

The invention makes it possible in particular to incorporate the preparation of samples into a microfluidic chip and to bring the samples towards the points of observation in a simple and robust manner.

A microfluidic circuit according to the invention can be applied in the field of biotechnology or "chimietech", but also in the field of fluid display and of observing reactions in microdrops.

Such a microfluidic circuit could have the form that has today become standard, such as "Micro-Arrays" or biochips, for example protein or DNA chips, or cell culture chips.

These biochips are comprised of a matrix of areas where the surface is functionalized with biomolecules, the size and the distance between these areas being of approximately the same size as the microfluidic drops and the troughs. The invention makes it possible to bring particular drops, of which the contents are known, towards the functionalized sites and to bring them into contact with the surface in order to produce the hybridization which will allow for the biological measurement. In this way, the invention makes it possible to interface the technology of biochips with the advantages of the manipulation of fluids in microfluidics.

As indicated previously, the trajectory of the drops can be modified actively, using a laser, in order to bring the drops into a trap or into a determined area of a microchannel.

In the case of a microchannel comprising several troughs, such a method can also be used to direct a drop from one trough to another, for example to select from among different trajectories that the drop could follow.

For this, when the fluids have a normal thermocapillary flow, the wavelength of the laser should be selected so that it is absorbed by the carrier fluid. The carrier fluid can, if required, contain a colorant (black ink for example) absorbing the wavelength of the laser. In this case, the local heating of the carrier fluid using the laser, in a trough or in the vicinity of the latter, attracts the drop into this trough. Heating can also be carried out at the interface between the drop and the carrier fluid in order to attract the drop into a determined trough.

When the fluids have an abnormal thermocapillary flow, the laser can be positioned in order to block the progress of a drop and divert it into another trough.

Heating can also be applied locally or globally using electric heating elements.

Furthermore, in the case where the fluids used do not absorb the laser, such an absorption can be carried out either directly by the material comprising the microchannel, or by depositing in the microchannel or in the trough a layer or a particle of a material that absorbs laser radiation.

Dielectrophoretic forces can also be used in order to influence the trajectory of the drops, or to trap drops.

Having described the invention, the following is claimed:

1. Microfluidic circuit comprising: a microchannel of a flow of a first fluid conveying drops or bubbles of at least one second fluid, wherein the microchannel has a cross-section perpendicular to a direction of flow of the first fluid such that the height of said cross-section of the microchannel is sized to crush the drops or the bubbles during their movement and the width of said cross-section of the microchannel is sized to be larger than the drop or bubble size, and wherein the microchannel comprises at least one trough, extending at least partially in the direction of flow of the first fluid, each of said at least one trough having a cross-section perpendicular to the direction of flow of the first fluid whose width is smaller than the width of said cross-section of said microchannel, wherein the microchannel is delimited by two parallel walls defining the height of said cross-section of the microchannel, each of said at least one trough being formed by a groove in at least one of said walls of the microchannel or between two ribs on one of said walls of the microchannel.

2. Circuit according to claim 1, wherein said cross-section of the at least one trough has a height greater than that of the microchannel.

3. Circuit according to claim 1, wherein bubbles or drops of at least two different types are conveyed by the first fluid and in that the at least one trough constitutes a means for separating or sorting bubbles or drops, with only those of a first type being guided into the at least one trough.

4. Circuit according to claim 3, wherein the bubbles or the drops of different types have different sizes, viscosities, or surface tensions.

5. Circuit according to claim 1, wherein the at least one trough comprises at least two successive portions of different height and/or width, with a portion of larger width and/or height being followed by a portion of lower width and/or height, in the direction of the flow of the first fluid.

6. Circuit according to claim 1, wherein the at least one trough comprises a plurality of troughs of different width and/or of different inclination in relation to the flow of the first fluid.

7. Circuit according to claim 1, comprising at least one area for trapping drops or bubbles, formed by an enlargement of a section of passage of the drops or of the bubbles in the microchannel or in the at least one trough, or via a local modification of the surface energy of the microchannel and/or of the at least one trough.

8. Circuit according to claim 1, comprising variations in width or in height of the at least one trough, or rails or ribs on the walls of the microchannel, formed along at least one area of the microchannel for slowing down or accelerating bubbles or drops.

9. Circuit according to claim 1, comprising a plurality of troughs formed in the microchannel to guide the drops or the bubbles of parallel streams of drops or of bubbles of different natures in the microchannel respectively to different areas of the microchannel.

10. Circuit according to claim 1, comprising a plurality of microchannels, the height of each of said microchannels being sized to crush the drops or the bubbles during their movement and the width of each of said microchannels being larger than the drop or bubble size, and wherein at least one of said microchannels comprises at least one trough, extending at least partially in the direction of flow of the first fluid, wherein each of said microchannels is delimited by two parallel walls defining the height of each of said microchannels, each of the at least one trough being formed by a groove in at least one of the walls of said at least one of said microchannels or between two ribs on one of the walls of said at least one of said microchannels.

11. Microfluidic circuit comprising: a microchannel of a flow of a first fluid conveying drops or bubbles of at least one second fluid, wherein the microchannel has a cross-section perpendicular to a direction of flow of the first fluid such that the height of said cross-section of the microchannel is sized to crush the drops or the bubbles during their movement and the width of said cross-section of the microchannel is sized to be larger than the drops or bubble size, and wherein the microchannel comprises at least one area for trapping drops or bubbles, each of said at least one area for trapping being formed by a first area of the microchannel surrounded by a second area of the microchannel such that said first area of the microchannel is higher than said second area thereof, each of said at least one area for trapping having a cross-section perpendicular to the direction of flow of the first fluid such that a width of said cross-section of each of said at least one area for trapping is smaller than the width of the microchannel.

12. Circuit according to claim 11, comprising a plurality of areas for trapping drops or bubbles.

13. Circuit according to claim 12, wherein at least some of the areas for trapping are connected in series or in parallel by the microchannel.

14. Circuit according to claim 12, wherein said microchannel comprises at least one trough, extending at least partially in the direction of flow of the first fluid, wherein the microchannel is delimited by two parallel walls, each of the at least one trough being formed by a groove in at least one of the walls of the microchannel or between two ribs on one of the walls of the microchannel, and wherein at least some of the areas for trapping are connected in series or in parallel by said at least one trough.

15. Circuit according to claim 11, wherein said at least one area for trapping drops or bubbles is formed by an enlargement of a section of passage of the drops or of the bubbles in the microchannel or via a local modification of the surface energy of the microchannel.

16. Circuit according to claim 11, wherein said microchannel comprises at least one trough, extending at least partially in the direction of flow of the first fluid, wherein the microchannel is delimited by two parallel walls, each of the at least one trough being formed by a groove in at least one of the walls of the microchannel or between two ribs on one of the walls of the microchannel.

17. Circuit according to claim 16, wherein said at least one area for trapping drops or bubbles is formed by an enlargement of a section of passage of the drops or of the bubbles in the at least one trough, or via a local modification of the surface energy of the at least one trough.

18. Circuit according to claim 11, wherein obstacles are formed downstream of the at least one area for trapping in order to retain in this at least one area the bubbles or the drops that have been drawn therein.

19. Circuit according to claim 11, comprising a plurality of microchannels of a flow of a first fluid conveying drops or bubbles of at least one second fluid, wherein the height of each of said microchannels is sized to crush the drops or the bubbles during their movement, and wherein at least one of said microchannels comprises at least one area for trapping drops or bubbles, each of said at least one area for trapping being formed by a first area of the microchannel surrounded by a second area of the microchannel such that said first area of the microchannel is higher than said second area thereof.

20. Method for treating drops or bubbles in a microfluidic circuit, comprising:

letting a first fluid flow in a microchannel of said microfluidic circuit, the first fluid conveying drops or bubbles of at least one second fluid, wherein the microchannel has a cross-section perpendicular to a direction of flow of the first fluid such that the height of said cross-section of the microchannel is sized to crush the drops or the bubbles during their movement and the width of said cross-section of the microchannel is sized to be larger than the drop or bubble size, wherein the microchannel is delimited by two parallel walls defining the height of said cross-section of the microchannel, and wherein the microchannel comprises at least one from:

a trough, extending at least partially in the direction of flow of the first fluid, and having a cross-section perpendicular to the direction of flow of the first fluid whose width is smaller than the width of said cross-section of the microchannel, the trough being formed by a groove in at least one of the said walls of the microchannel or between two ribs on one of the said walls of the microchannel, and an area for trapping drops or bubbles, said area for trapping being formed by a first area of the microchannel surrounded by a second area of the microchannel such that said first area of the microchannel is higher than said second area thereof, said area for trapping having a cross-section perpendicular to the direction of flow of the first fluid whose width is smaller than the width of said cross-section of the microchannel; and letting at least one drop or bubble of the second fluid be drawn and guided into the trough or the trapping area.

* * * * *